US005996138A

United States Patent [19]

Kentch

[11] Patent Number: 5,996,138

[45] Date of Patent: Dec. 7, 1999

[54] SYSTEM AND METHOD FOR CONTRIBUTING TO THE CONTROL OF THE TOTAL DISSOLVED SOLID LEVELS IN A POOL AND FOR CONSERVING WATER

[76] Inventor: Dennis Kentch, 1004 Vista Dr., Lake Havasu, Ariz. 86404

[21] Appl. No.: 09/130,381

[22] Filed: Aug. 6, 1998

[51] Int. Cl.[6] ..... E04H 4/00

[52] U.S. Cl. ..... 4/508; 4/488; 4/490; 210/169; 210/85

[58] Field of Search ..... 4/505, 506, 507, 4/508, 490, 488; 210/109, 169, 416.2, 739, 805, 85

[56] References Cited

U.S. PATENT DOCUMENTS 5,366,021 11/1994 Coleman ..... 210/169

5,895,565 4/1999 Steininger et al. ..... 210/85

*Primary Examiner*—Henry J. Recla

*Assistant Examiner*—Khoa Huynh

*Attorney, Agent, or Firm*—Philip J. Anderson; Quirk & Tratos

[57] ABSTRACT

A system and method are set forth for decreasing the levels of total dissolved solids (TDS) in a swimming pool and for conserving water. An amount of water is drawn from the swimming pool water circulating system and delivered to a demand such as irrigation or used to supplement the potable water system. If evaporative coolers are present, their waste water discharge can likewise be conserved and used to fill a demand such as irrigation.

20 Claims, 2 Drawing Sheets

SYSTEM AND METHOD FOR CONTRIBUTING TO THE CONTROL OF THE TOTAL DISSOLVED SOLID LEVELS IN A POOL AND FOR CONSERVING WATER

FIELD OF THE INVENTION

The present invention relates to systems and methods for controlling the total dissolved solids (TDS) in a closed water system subject to evaporation-driven increases in TDS such as swimming pools, spas and fountains.

BACKGROUND OF THE INVENTION

In areas where it is hot and dry such as the American Southwest, the evaporation of water from spas, swimming pools and fountains (hereinafter collectively referred to as pools) tends to cause increases in the level of total dissolved solids in the water. Chemicals have been used to attempt to control TDS unsuccessfully.

The increased levels of total dissolved solids tend to require the use of even greater amounts of chemical agents to control the scaling and staining of the walls of the pool and for clarity of the pool water. Further for commercial units such as municipal or hotel pools, human use also contributes to an increase in TDS.

In addition to the use of chemical agents, it is a typical practice to periodically empty and refill the pool because of the buildup of TDS. Disposal of drained pools, such as a 20,000 gallon pool, are, in most instances done by draining the pool to storm sewer systems or into the street or other convenient location. This is not only wasteful of an important natural resource, water, but also can strain municipal storm sewer treatment systems and contributes to the degradation of the infrastructure such as concrete, streets, curbs, pipes and gradings due to the chemical agents and high total dissolved solids in the drain water.

For example, in a municipality with 10,000 pools holding an average of 20,000 gallons per pool would amount to 200,000,000 gallons of water disposed of per year by emptying pools.

In an unrelated system, some homes or businesses have evaporative coolers for air conditioning purposes. The water not evaporated during the evaporative process for cooling, is discharged as waste. A typical example would be an evaporative cooler which discharges an average of 6 gallons of waste water per hour for ten hours per day. At 68 cooling days per year, that equals 4080 gallons of water per year per cooler which is treated as a nuisance and discharged.

There is a need to conserve the water heretofore discharged into storm sewer systems or otherwise treated as a nuisance. There is also a need for a system which can control the TDS levels in pools to maintain the clarity, reduce scaling and staining and avoid the expense of cleaning and draining and to further reduce the amount of chemical additives required for the pool.

SUMMARY OF THE INVENTION

There is, therefore, set forth according to the present invention a water conservation system and method for a closed water system subject to evaporation-driven accumulation of total dissolved solids (TDS) such as a swimming pool, spa, pond or fountain of the type which includes a circulation pump to circulate the water and a makeup water supply. The system and method includes making a connection between the discharge of the circulating pump and a demand for water. This demand may be for plant irrigation, a potable water supply or the like. Disposed in the connection are suitable means for drawing a flow of water from the closed water system at a controlled rate. The drawn off water and water loss through evaporation is made up by a fresh water makeup system. The drawing off of a controlled and/or metered amount from the pool on a regular basis and the resupply by makeup water contributes to the control of TDS in the pool by providing, in essence, a continual circulation of fresh water into the pool system.

Where it is desired to supply the drawn water to a potable water system, the method and system includes a pump made in the connection to increase the pressure of the drawn water to a level sufficient for introduction into a potable water system. A sensor may be disposed to sense the condition of the drawn water and to terminate the supply to the potable water system where the drawn water is sensed to be unpotable.

The system and method for a pool and evaporative cooler system, includes the connection and means for drawing a flow of water from the pool described above as well as a reservoir tank to receive the drawn water. The evaporative cooler discharge is directed to the tank to, along with the drawn water, provide a supply for any suitable water demands such as irrigation or for introduction into a potable water system as described above.

BRIEF DESCRIPTION OF THE DRAWINGS

These and other features and advantages will become appreciated as the same becomes better understood with reference to the specification, claims and drawings wherein

DESCRIPTION

Figure 1:
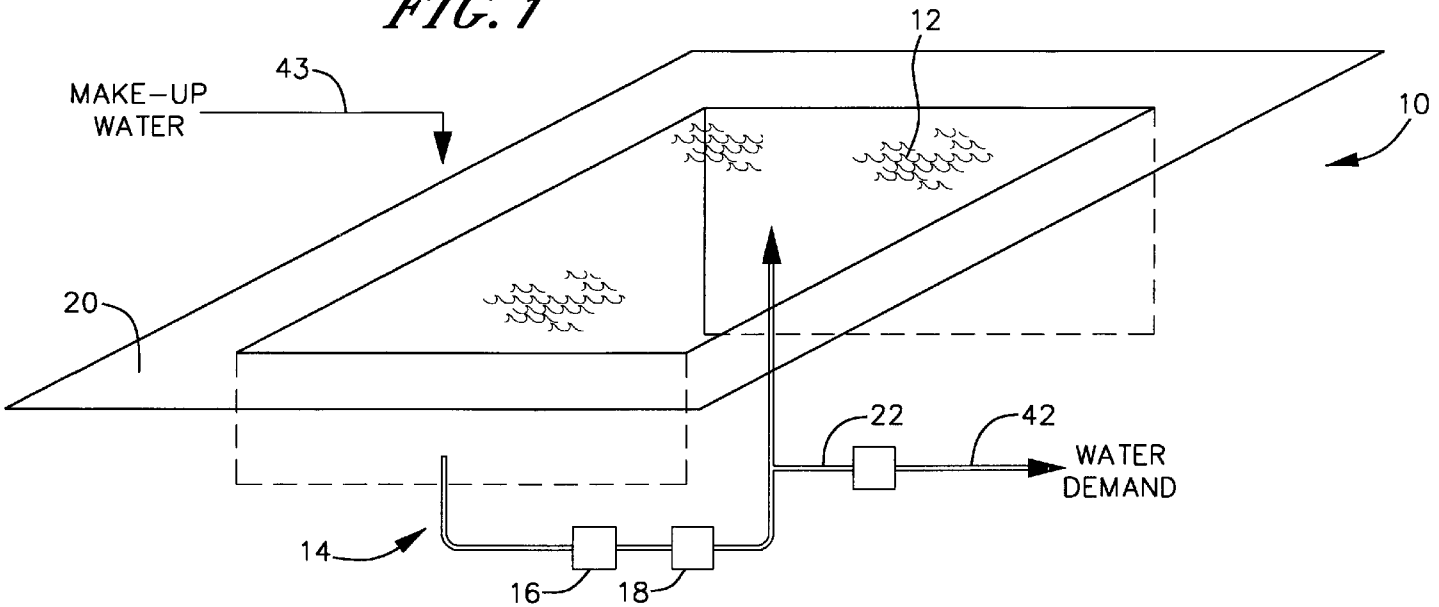
FIG. 1 is a general system diagram showing a pool.

Turning to the drawings, FIG. 1 illustrates the system 10 and method according to the present invention used with a swimming pool 12. While this description is directed to use of the system 10 and method with a swimming pool 12, it is to be understood that it could be used with any closed system which is subject to evaporation-driven increases in total dissolved solids (TDS) such as spas, ponds, fountains and the like. As illustrated, typically the pool 12 will have a circulation loop 14 including a circulation pump 16 and pool filter 18. As illustrated, the suction side of the circulation pump 16 takes water from the swimming pool 12, pumps it through the pool filter 18 for filtration thereof and returns the water to the pool 12. Also shown is a decking 20 around the pool.

As illustrated, at the discharge side of the circulation pump 16 and preferably downstream of the pool filter 18, a connection 22 is made into the circulation loop 14 for the purposes which will hereinafter become evident.

Figure 2:
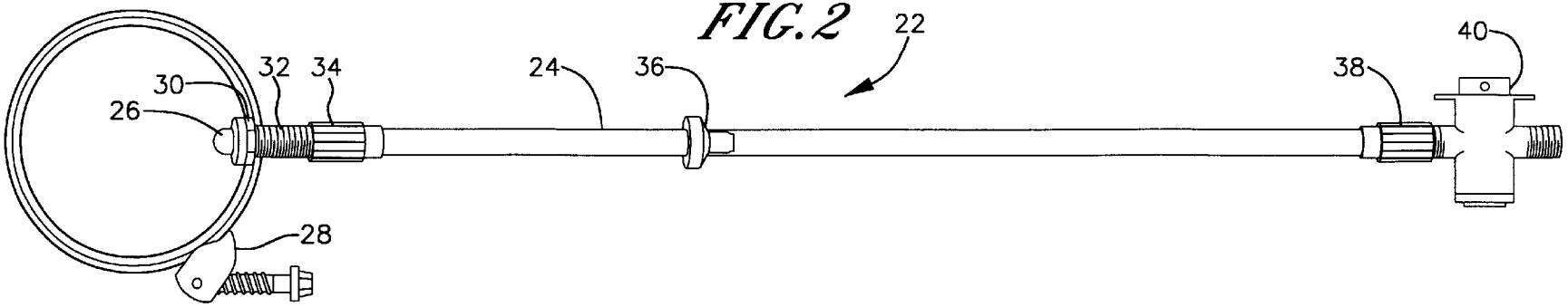
FIG. 2 is a view of the connection to the circulating pump discharge for drawing water according the present invention.

With reference to FIG. 2, the connection 22 is generally shown. The connection 22 includes a conduit 24 which at one end includes a penetration 26 into the piping of the circulation loop 14. A saddle clamp 28 holds the connection 22 to the piping of the circulation loop 14 and the penetration 26 in place. The penetration 26 penetrates the side of the pipe of the circulation loop 14 for the purposes of drawing water therefrom and from the closed pool system. Accordingly the penetration 26 includes a sealing gasket 30 and, for example, a ¼ inch threaded nipple 32 having at one end a connection nut 34 for connecting the penetration 26 to, for example, a ¼ inch internal diameter conduit 24. To prevent backflow through the conduit 24 in a direction toward the penetration 26, an in-line check valve 36 is provided in the conduit 24.

Opposite the penetration 26, the connection 22 has a retaining nut 38 which is connected to a flow control valve 40 adapted to draw preferably a measured amount of water from the circulation loop 14. Downstream of the flow control valve 40 is a water demand 42 (FIG. 1) such as an irrigation system or the like.

In operation, the connection 22 is secured to the circulation loop 14 with the penetration 26 penetrating the side of the circulation loop piping downstream of the discharge of the circulating pump 16. Accordingly water is supplied from the circulation loop 14 to the conduit 24 through the penetration 26 at pressure substantially as supplied by the circulation pump 16. By use of the flow control valve 40, a measured and metered amount of water is drawn from the circulation loop 14 and thereby from the closed pool system. This drawn out amount is made up to the pool 12 from a makeup water supply 43 (FIG. 1) such as by a connection to a municipal water system.

In, for example, a pool 12 having a capacity of 20,000 gallons, it has been found that by setting the flow control valve 40 to draw approximately 20–60 gallons a day from the circulation loop 14 contributes significantly to reducing the TDS levels in the pool 12 and thereby reducing the amount of scaling attributable to TDS as well as contributing to the clarity of the water in the pool 12. The amount drawn represents approximately (0.75×Pool Volume)/Year. Furthermore the water drawn off by the connection 22 and through the flow control valve 40 is supplied to fulfill a demand such as irrigation. For example, a coupling may be made to the flow control valve 40 such as a hose or tube to supply water to shrubbery, trees, crops or the like.

Accordingly, the connection 22 and flow control valve 40 not only contribute to reducing the TDS of the pool but also conserve water by supplying it to fulfill a demand such as irrigation.

Figure 3:
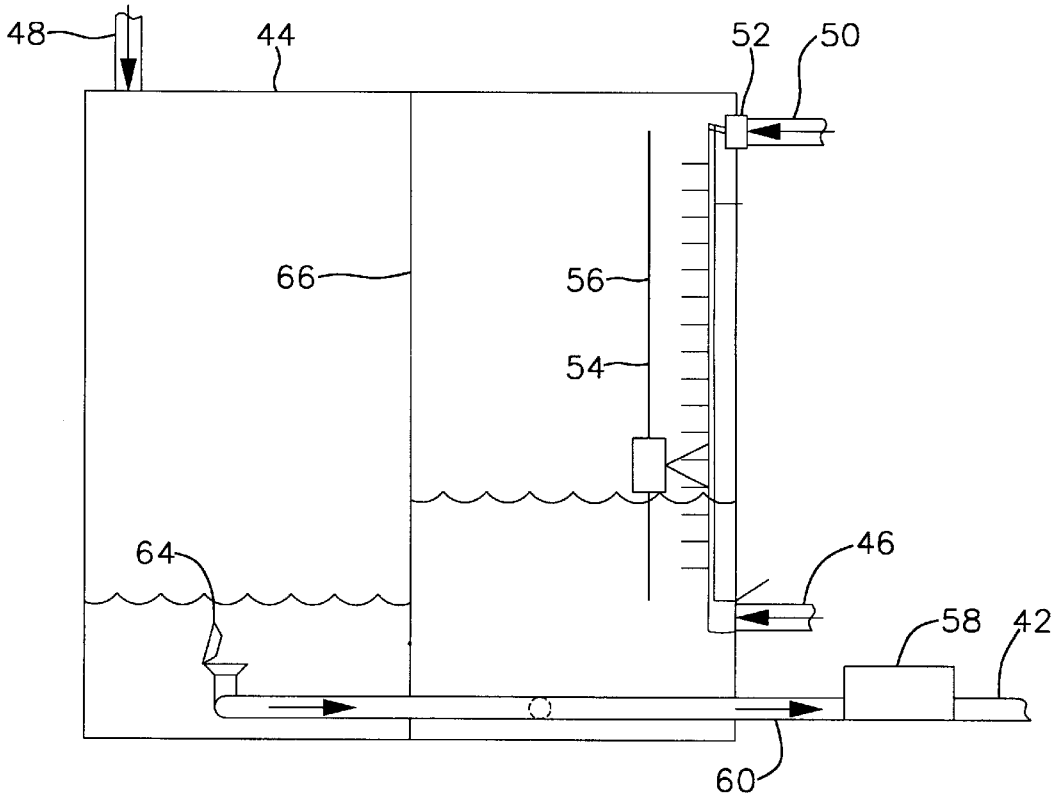
FIG. 3 is a side view of a further embodiment and method of the system.

With reference to FIG. 3, a further embodiment of the present invention is shown. This embodiment is directed to, for example, residential uses which not only include a swimming pool 12 but also have evaporative cooler(s)(not shown) which rely on the circulation of fresh water for air conditioning. Typically these evaporative coolers, sometimes referred to as swamp coolers, have a discharge of up to 6 gallons per hour that is not evaporated for cooling. As described above, typically this 6 gallon per hour rate is simply disposed of by directing it to a gutter, the ground or the like.

With reference to FIG. 3, the system and method of the present invention includes a reservoir tank 44 having a first inlet 46 for water drawn from the pool 12, i.e., as controlled by the flow control valve 40 of FIG. 2, and a second inlet 48 from the discharge of at least one evaporative cooler. Accordingly the waste water from the evaporative cooler(s) is supplied to the tank 44 as is the water drawn from the pool 12. A third inlet 50 is also provided to supply outside, makeup water to the tank 44 to maintain the level thereof. A fill valve 52 is disposed at the third inlet to open and close to admit makeup water to the tank 44. To control the level of the water in the tank 44, suitable level control means may be provided such as a slide float 54 slidably disposed on a rod 56 and controlling the operation of the fill valve 52. Accordingly by setting the position of the float 54, the fill valve 52 can be controlled to admit makeup water to maintain the preset level in the tank 44.

To supply the water in the tank 44 to a water demand, a supply pump 58 is provided, its suction side 60 in communication with the water in the tank 44 and its discharge side directed to the demand 42, such as irrigation. The suction 60 may include a cone seat valve 64 to terminate the flow to the suction 60 of the supply pump 58.

With continuing reference to FIG. 3, it is seen that the tank 44 may include an internal partition 66 to segregate the supply of water through the connection 22 from the water supplied from the evaporative coolers. Similarly, the third inlet 50 which is makeup water from a municipal source may only communicate with the pool water side of the tank 44 as defined by the partition 66.

As can be appreciated, as water is drawn from the pool 12 through the connection 22, as controlled by the flow control valve 40, and it is supplied to the tank 44. Similarly the discharge from at least one evaporative cooler is also supplied to the tank 44 to define a reservoir of water available to fulfill a demand such as irrigation. When irrigation is desired, the supply pump 58 is activated to pump water from the tank 44 to fulfill that demand.

Figure 4:
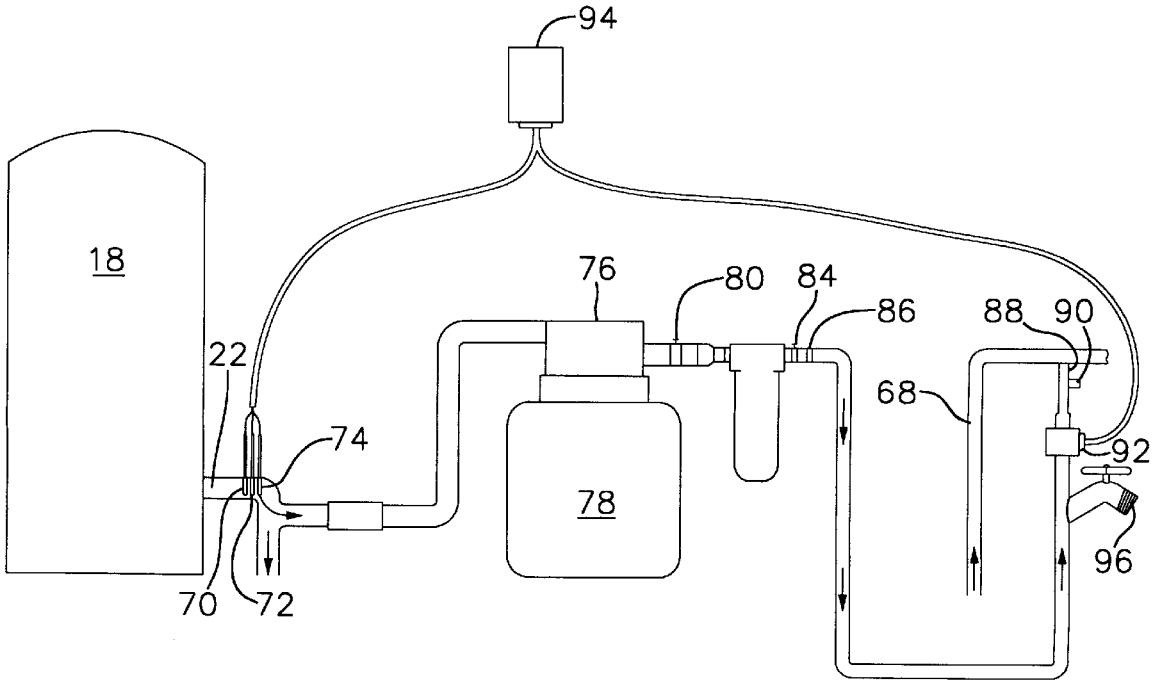
FIG. 4 is a view of a system for supplying the water conserved according to the system and method of the present invention to a potable water supply.

Turning to FIG. 4, yet another embodiment of the present invention is illustrated. According to this embodiment, the water drawn from the pool 12 is injected into a potable water supply such as into the water main 68 for a residence.

According to this embodiment, the connection 22 is made downstream of the pool filter 18 into the circulation loop 14. Upstream of the connection 22 sensing means such as a first chlorine sensor 70, pH sensor 72, and/or total dissolved solids (TDS) sensor 74 are provided. The water supplied through the connection 22 is drawn by a low-volume, high pressure supply pump 76 into, for example, a 10-gallon bladder tank 78 at a pressure greater than that supplied by the water main to the residence. The bladder tank 78 maintains the water pumped therein by the supply pump 76 at the aforesaid pressure. A shut-off valve 80 may be provided downstream of the bladder tank 78. Disposed downstream of the bladder tank 78 is a supply water filter 82 preferably a 5 micron carbon filter. The supply water filter 82 is adapted to remove any particulates and the like in the water prior to injection into the potable water system. The supply water filter 82 may be isolated by a shut-off valve 84 for removal and replacement thereof. Downstream of the supply filter 82 there is preferably a second chlorine sensor 86 to sense the chlorine level in the water discharged from the supply water filter 82. From the supply water filter 82 the system 10 includes a coupling 88 to place the discharge from the supply water filter 82 into communication with the water main 68. This coupling 88 may be a ¼ inch copper tubing including a flow control valve 90 and a solenoid operated shut-off valve 92. Accordingly as can be appreciated, the pumping of the water drawn from the pool 12 through the pool filter 18 is raised in pressure and placed in the bladder tank 78 for supply through the supply water filter 82 into the water main 68 through the flow control valve 90 and shut-off valve 92. The flow control valve 90 may be manipulated to control the amount of water injected into the potable supply from the water main for dilution thereof.

Each of the sensors, the first chlorine sensor 70, pH sensor 72, TDS sensor 74 and second chlorine sensor 86 are connected to a suitable processing and control unit 94. In response to sensing that the condition of the water drawn from the pool 12 is incompatible for injection into the potable water supply, the processor controller 94 shuts off the solenoid operated shut-off valve 92 to prevent the supply thereof. In the event of shut off of the injection of the water into the potable water supply to the residence, the operator may use a hose bib 96 which can be turned on to supply the water drawn from the pool 12 for irrigation purposes.

While is shown and described certain embodiments of the present invention, it is to be understood that it is subject to many modifications and changes without departing from the spirit and scope of the appended claims.

I claim:

1. A water conservation system for a closed water system subject to evaporation-driven accumulation of total dissolved solids (TDS), the water system having a reservoir, a circulation pump to circulate the water to and from the reservoir and means for introducing fresh make-up water to maintain the supply of the water in the reservoir, the system comprising:

a connection between the discharge of said pump and a demand for water; and means disposed in the connection for drawing a small portion of the flow of water from said closed water system on a regular basis to carry water with a high TDS concentration from the closed water system to the demand, said means for introducing make-up water replenishing the reservoir with fresh water for the water removed by the drawing means for controlling the accumulation of TDS at the reservoir.

2. The system of claim 1 wherein the demand is an irrigation conduit.

3. The system of claim 1 wherein said drawing means includes a normally closed control valve adapted to periodically open to draw said water.

4. A water conservation system adapted to contribute to the control the total dissolved solid (TDS) concentration in a pool system having a pool water circulation pump and means for maintaining the level of water in the pool with fresh make-up water, the system comprising:

a connection between the discharge of said circulation pump and a demand for water;

means disposed in said connection for regulating the flow of water through the connection to draw a small portion of the total flow of water with a high TDS concentration from the pool system on a regular basis for supply to said demand, said make-up water replacing said drawn water with fresh make-up water to contribute to the control of the level of TDS in said pool system.

5. The system of claim 4 wherein said demand is an irrigation conduit, said system further including means for placing said connection in communication with said irrigation conduit.

6. The system of claim 4 wherein said flow regulating means is adapted to draw at a rate corresponding to a daily rate of approximately equal to 0.75×Pool Volume/365.

7. A method for controlling the total dissolved solids (TDS) of a pool system having a circulation pump, the method comprising:

making a connection with the discharge side of said circulation pump; and drawing off a small portion of the total flow of water having a high TDS concentration from said pool system on a regular basis for supply to a water demand; and providing fresh make-up water to said pool to maintain the level thereof.

8. The method of claim 7 including directing the drawn off water to an irrigation conduit for watering plants.

9. In a system including a pool having a circulation pump and at least one evaporative cooler having a condensate discharge, a method for controlling the total dissolved solid (TDS) of the water in said pool and for conserving water comprising:

providing a storage tank;

making a connection with the discharge side of said circulation pump;

drawing off a measured amount of water from said pool system on a regular basis for supply to said tank;

directing the condensate discharge to said tank;

providing fresh make-up water to said pool to maintain the level thereof, said introduction of fresh make-up water adapted to control the pool TDS; and using the water stored in the tank to fulfil a demand for water.

10. A water conservation system for a closed water system subject to evaporation-driven accumulation of total dissolved solids (TDS), the water system having a reservoir, a circulation pump to circulate the water to and from the reservoir and means for introducing fresh make-up water to maintain the supply of the water in the reservoir, the system comprising:

a connection between the discharge of said pump and a demand for water;

means disposed in the connection for drawing a flow of water from said closed water system on a regular basis to control TDS;

a supply pump disposed in said connection, said pump having a discharge adapted to be in communication with a potable water supply and said pump adapted to produce a discharge pressure sufficient to introduce water into the potable water supply;

means for sensing the drawn water and means for interrupting the introduction of water into the potable water supply in response to sensing that the drawn water would not be potable; and means for actuating said pump to draw said water, said drawn water introduced into said potable water supply.

11. The system of claim 10 further including a filter disposed between said supply pump and said potable water supply adapted to filter particulates.

12. The system of claim 10 further including a tank disposed to receive said drawn water to provide a supply thereof, a supply of fresh make-up water and means for maintaining the level of said tank.

13. A water conservation system adapted to contribute to the control the total dissolved solid (TDS) concentration in a pool system having a pool water circulation pump and means for maintaining the level of water in the pool with fresh make-up water, the system comprising:

a connection between the discharge of said circulation pump and a potable water supply;

means disposed in said connection for regulating the flow of water through the connection to draw a quantity of water from the pool system on a regular basis for supply to said demand, said make-up water replacing said drawn water to contribute to the control of the level of TDS in said pool system;

a supply pump disposed in said connection, said pump having a discharge adapted to be in communication with said potable water supply and said pump adapted to produce a discharge pressure sufficient to introduce water into the potable water supply;

means for sensing the drawn water and means for interrupting the introduction of water into the potable water supply in response to sensing that the drawn water would not be potable; and means for actuating said pump to draw said water, said drawn water introduced into said potable water supply.

14. The system of claim 13 further including a filter disposed between said supply pump and said potable water supply adapted to filter particulates.

15. The system of claim 13 further including a tank to receive and store said drawn water.

16. The system of claim 15 further including means for supplying condensate from at least one evaporative cooler to said tank.

17. The system of claim 16 wherein said tank has a first compartment to receive said drawn water and a second compartment to receive said condensate.

18. The system of claim 17 further including a supply of make-up water and means for maintaining the water level of at least one of said first or second compartments of said tank.

19. The system of claim 15 further including a supply of make-up water and means for maintaining the level of said tank.

20. The system of claim 15 further including a supply pump disposed in said connection, said pump having a discharge in communication with said potable water supply and said pump adapted to produce a discharge pressure sufficient to introduce water into the potable water supply; and means for actuating said pump to draw said water, said drawn water introduced into said potable water supply.

* * * * *